US006782225B2

(12) United States Patent
Kai et al.

(10) Patent No.: US 6,782,225 B2
(45) Date of Patent: Aug. 24, 2004

(54) IMAGE FORMING APPARATUS HAVING PLURALITY OF DEVELOPING SECTIONS WITH PARTICULAR MAGNETIC FLUX DENSITY

(75) Inventors: Tsukuru Kai, Kanagawa (JP); Hisashi Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/713,156

(22) Filed: Nov. 17, 2003

(65) Prior Publication Data

US 2004/0096245 A1 May 20, 2004

Related U.S. Application Data

(62) Division of application No. 09/945,839, filed on Sep. 5, 2001, now Pat. No. 6,671,484.

(30) Foreign Application Priority Data

Sep. 5, 2000 (JP) ..... 2000-268580
Sep. 28, 2000 (JP) ..... 2000-297357

(51) Int. Cl.[7] ..... G03G 15/01
(52) U.S. Cl. ..... 399/223; 399/227; 399/277
(58) Field of Search ..... 399/223, 226, 399/227, 267, 269, 277

(56) References Cited

U.S. PATENT DOCUMENTS 5,630,201 A * 5/1997 Suzuki et al. ..... 399/269
6,385,423 B1 * 5/2002 Kai ..... 399/277
6,397,031 B1 * 5/2002 Itoh ..... 399/269
6,449,452 B1 * 9/2002 Kai ..... 399/267
6,671,484 B2 * 12/2003 Miyoshi et al. ..... 399/277

FOREIGN PATENT DOCUMENTS

JP 09022190 A * 1/1997 ..... G03G/15/09
JP 10048955 A * 2/1998 ..... G03G/15/09

* cited by examiner

*Primary Examiner*—Robert Beatty
(74) *Attorney, Agent, or Firm*—Oblon, Spivak, McClelland, Maier & Neustadt, P.C.

(57) ABSTRACT

In a developing device including a plurality of developing sections each including a developer carrier that causes a developer deposited thereon to form a magnet brush and contact an image carrier, the developer carrier including: a rotatable nonmagnetic sleeve; and a stationary magnet roller accommodated in the sleeve and including a magnetic pole for scooping up the developer to the sleeve, a magnetic pole for conveying the developer deposited on the sleeve, and a main magnetic pole for causing the developer to rise on the sleeve in a form of the magnet brush. The plurality of developing sections include at least one developing section in which a flux density of the main magnetic pole in a normal direction has an attenuation ratio of 40% or above and at least one developing section in which said flux density has an attenuation ratio of 30% or below.

26 Claims, 16 Drawing Sheets

FIG. 4A

MAGNET ROLLER FOR Bk WITH DIAMETER OF 30mm

| | P1a | P1b | P1c | P2 | P3 | P4 | P5 | P6 | P7 | P8 |
|---|---|---|---|---|---|---|---|---|---|---|
| FLUX DENSITY (mT) | 107.4 | 108.0 | 104.6 | 82.2 | – | 61.1 | 66.1 | 59.5 | 100.0 | 75.8 |
| CENTER HALF ANGLE | 345 (-15.0) | 0 | 15.6 | 60.1 | – | 140.6 | 185.7 | 220.7 | 272.3 | 311.5 |
| HALF WIDETH | 11.6 | 9.7 | 12.1 | 24.3 | – | 26.5 | 25.9 | 20.8 | 27.2 | 19.0 |
| POLE | S | N | S | N | | N | S | N | S | N |

FIG. 4B PRIOR ART

MAGNET ROLLER FOR OTHER COLOR WITH DIAMETER OF 30mm

| | P1 | P2 | P3 | P4 | P5 | P6 | P7 | P8 |
|---|---|---|---|---|---|---|---|---|
| FLUX DENSITY (mT) | 107.8 | 70.2 | – | 67.2 | 59.3 | 53.7 | 86.8 | 71.8 |
| CENTER HALF ANGLE | 0 | 56.5 | – | 138.7 | 185.0 | 222.6 | 270.9 | 318 |
| HALF WIDTH | 27.8 | 23.3 | – | 23.6 | 23.8 | 26.3 | 24.8 | 29.1 |
| POLE | N | S | | S | N | S | N | S |

| | GRANULARITY | LOCAL OMISSION |
|---|---|---|
| 20T/m | 3.0 | 3.0 |
| 30T/m | 3.5 | 3.5 |
| 35T/m | 3.5 | 3.5 |
| 40T/m | 4.0 | 3.5 |
| 45T/m | 4.0 | 4.0 |

| | GRANULARITY | LOCAL OMISSION |
|---|---|---|
| 20T/m | 3.0 | 3.0 |
| 30T/m | 3.5 | 3.5 |
| 35T/m | 3.5 | 3.5 |
| 40T/m | 3.5 | 4.0 |
| 45T/m | 4.0 | 4.0 |

| | GRANULARITY | LOCAL OMISSION |
|---|---|---|
| 20T/m | 3.0 | 3.0 |
| 30T/m | 3.5 | 3.5 |
| 35T/m | 3.5 | 3.5 |
| 40T/m | 4.0 | 4.0 |
| 45T/m | 4.0 | 4.0 |

IMAGE FORMING APPARATUS HAVING PLURALITY OF DEVELOPING SECTIONS WITH PARTICULAR MAGNETIC FLUX DENSITY

BACKGROUND OF THE INVENTION

1. Field of the Invention

The present invention relates to an image forming apparatus including a developing device of the type causing a developer to form a magnet brush on the surface of a developer carrier in a developing region, or nip for development, and contact and thereby develops a latent image formed on an image carrier.

2. Description of the Background Art

It is a common practice with a copier, printer, facsimile apparatus or similar electrophotographic or electrostatic image forming apparatus to electrostatically form a latent image on an image carrier in accordance with image data. The image carrier may be implemented by a photoconductive drum or a photoconductive belt. A developing device develops the latent image with toner and thereby produces a corresponding toner image. A current trend in the imaging art is toward a magnet brush type developing system using a toner and carrier mixture or two-ingredient type developer. This type of developing system is desirable from the standpoint of image transfer, halftone reproducibility, and stability of development against varying temperature and humidity. Specifically, a developing device using this type of system causes the developer to rise in the form of brush chains on a developer carrier, so that toner contained in the developer is transferred to a latent image formed on the image carrier at a developing region. The developing region refers to a range over which a magnet brush rises on the developer carrier and contacts the image carrier.

The developer carrier is generally made up of a hollow cylindrical sleeve or developing sleeve and a magnet roller surrounded by the sleeve. The magnet roller forms a magnetic field for causing the developer deposited on the sleeve to rise in the form of a magnet brush. When the developer rises on the sleeve, carrier particles contained therein rise along magnetic lines of force generated by the magnet roller. Charged toner particles are deposited on each of such carrier particles. The magnet roller has a plurality of magnetic poles formed by rod-like magnets and including a main pole for causing the developer to rise in the developing region.

In the above-described configuration, when at least one of the sleeve and magnet roller moves, it conveys the developer to the developing region. In the developing region, the developer rises in the form of brush chains along the magnetic lines of force generated by the main pole. The brush chains or heads contact the surface of the image carrier while yielding themselves. While the brush chains sequentially rub themselves against a latent image formed on the image carrier on the basis of a difference in linear velocity between the developer carrier and the image carrier, the toner is transferred from the developer carrier to the image carrier.

In a developing device of the type described, the flux density of the main pole in the normal direction decreases little by little toward opposite ends of the developing region while the flux density in the tangential direction increases little by little. As a result, the magnet brush tilts more at the end portions than at the intermediate portion of the developing region, resulting in defective images. For example, the crossing portions of solid lines, a black solid image or a halftone solid image is lost at its trailing edge portion (local omission hereinafter). Further, horizontal lines and dots are not faithfully reproduced. More specifically, horizontal lines included in a lattice pattern having the same width are rendered thinner than vertical lines or a dot image is not developed at all.

Japanese Patent Application No. 2000-29637, for example, discloses an image forming apparatus constructed to implement desirable image density and image quality by obviating the above-mentioned defects. The apparatus taught in this document uses a magnet formed of ion-neodymium-boron alloy, iron-neodymium-boron alloy bond or similar rare earth metal alloy or samarium alloy in order to reduce a half width while maintaining a magnetic force required of the main pole. Such a magnet, however, noticeably increases the cost of the magnet roller. This problem is particularly serious when it comes to a color image forming apparatus.

Japanese Patent No. 2,773,151, for example, proposes to position the peak of the variation of a magnetic field component (flux density) in the tangential direction in the developing region and to limit the absolute value of the peak to 30 gauss/degree. With such a peak, according to the above document, it is possible to cause the carrier to sufficiently fall down at the opposite sides of the developing region.

The above Japanese Patent describes that as for the flux density of a horizontal magnetic field component, the illustrative embodiment stabilizes the variation ratio of the density around the center, where the flux density is minimum, more than the conventional device, and increases the variation ratio at a preselected distance from the center at both sides of the center. The document further describes that the vertical and horizontal magnetic field components each vary by a great ratio at opposite end portions of the developing region, and therefore the rise/fall of the magnet brush at the opposite end portions is sharp. Theoretically, if the developing region is relatively broad, it may be possible to form portions where the magnetic force density component noticeably varies at opposite ends of the developing region while stabilizing the variation of the magnetic force density at the intermediate portion. In practice, however, the developing region available with an image forming apparatus of the type using a toner and carrier mixture is so narrow, it is difficult to locate the peak of the flux density in the tangential direction at opposite ends of the developing region. Moreover, a decrease in the diameter of the sleeve results in a decrease in the distance for an angle of 1 degree on the surface of the sleeve, so that the fall-down of the carrier particles has little effect.

Technologies relating to the present invention are also disclosed in, e.g., Japanese Patent Laid-Open Publication No. 2000-305360.

SUMMARY OF THE INVENTION

It is a fist object of the present invention to provide a cost effective, image forming apparatus capable of increasing image density and faithfully reproducing even low-contrast images.

It is a second object of the present invention to provide an image forming apparatus capable of reducing image defects, including granularity and local omission, to thereby enhance image quality even if a range over which a magnet brush and an image carrier contact is reduced.

In accordance with the present invention, in a developing device including a plurality of developing sections, each developing section includes a developer carrier that causes a developer deposited thereon to form a magnet brush and contact an image carrier. The developer carrier includes a rotatable nonmagnetic sleeve and a stationary magnet roller accommodated in said sleeve. The magnet roller has a magnetic pole for scooping up the developer to the sleeve, a magnetic pole for conveying the developer deposited on the sleeve, and a main magnetic pole for causing the developer to rise on the sleeve in the form of the magnet brush. The developing sections each include at least one developing section in which the flux density of the main magnetic pole in the normal direction has an attenuation ratio of 40% or above and at least one developing section in which the flux density has an attenuation ratio of 30% or below.

Also, in accordance with the present invention, in a developing device including a plurality of developing sections, each developing section includes a developer carrier that causes a developer deposited thereon to form a magnet brush and contact an image carrier. The developer carrier includes a rotatable nonmagnetic sleeve and a stationary magnet roller accommodated in said sleeve. The magnet roller has a magnetic pole for scooping up the developer to the sleeve, a magnetic pole for conveying the developer deposited on the sleeve, and a main magnetic pole for causing the developer to rise on the sleeve in the form of the magnet brush. The developing sections each include at least one developing section in which the main pole has a half width of 22° or below and at least one developing section in which the half value is 25° or above.

BRIEF DESCRIPTION OF THE DRAWINGS

The above and other objects, features and advantages of the present invention will become more apparent from the following detailed description taken with the accompanying drawings in which:

FIG. 4A is a table listing various factors, including a flux density, particular to a magnetic roller included in the developing roller and assigned to black toner;

FIG. 4B is a table listing the same factors as FIG. 4A, but relating to a magnet roller assigned to color toner of a color other the black toner;

DESCRIPTION OF THE PREFERRED EMBODIMENTS

Figure 1:
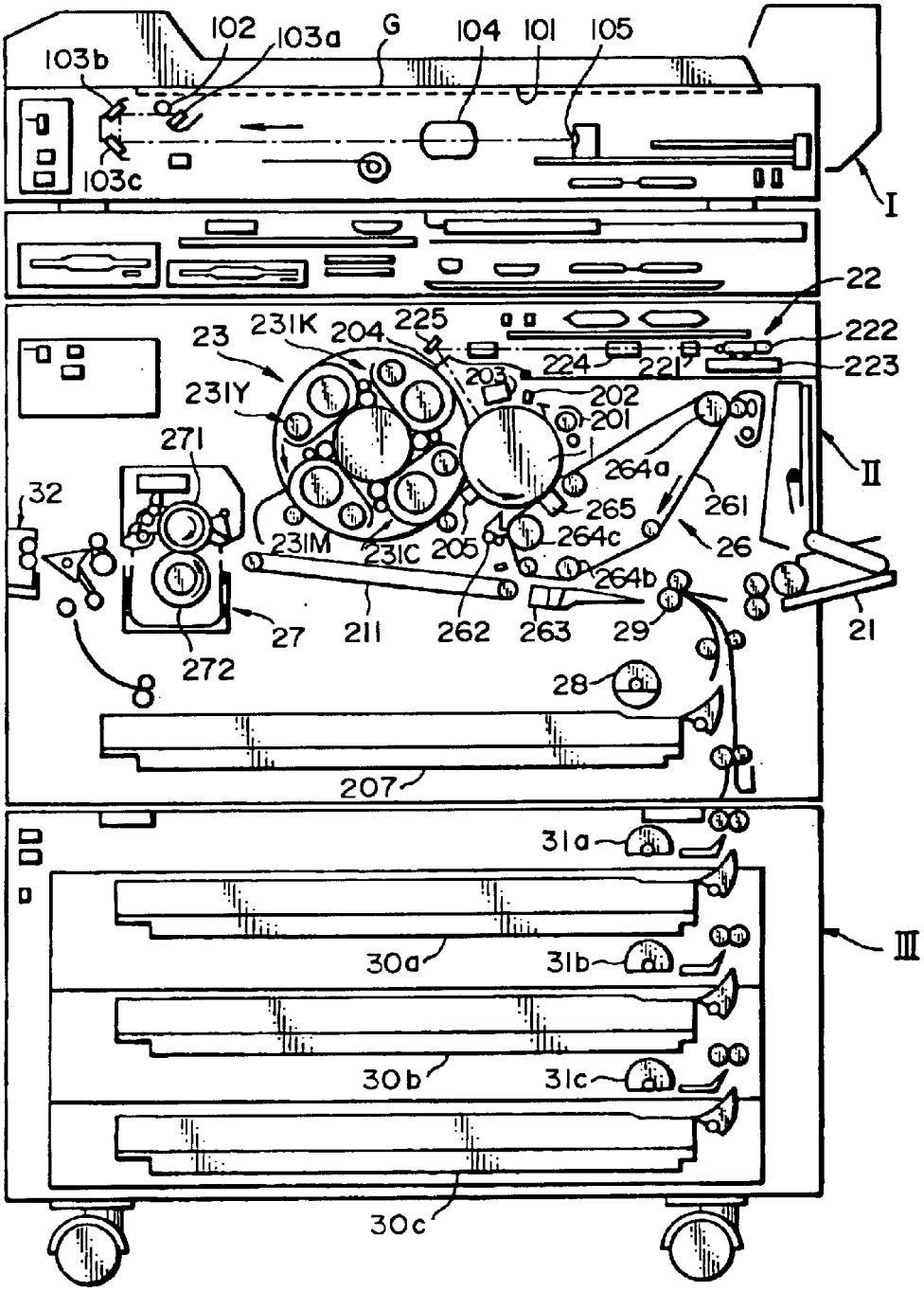
FIG. 1 is a view showing the general construction of an image forming apparatus embodying the present invention.

Referring to FIG. 1 of the drawings, an image forming apparatus embodying the present invention is shown and implemented as an electrophotographic color copier by way of example. The illustrative embodiment is directed mainly to the first object stated earlier. As shown, the color copier is generally made up of a color scanner or color image reading device I, a color printer or color image recording device II, and a sheet bank III.

The color scanner I includes a glass platen 101 on which a document G is laid. While a lamp 102 illuminates the document G, the resulting reflection from the document G is incident to a color sensor 105 via mirrors 103*a*, 103*b* and 103*c*, and a lens 104. With this configuration, the color scanner I reads color information out of the document G color by color, e.g., red, green and blue separated from each other and then converts the color information to electric image signals. In the illustrative embodiment, the color sensor 105 includes red, green and blue color separating means and CCDs (Charge Coupled Devices) or similar photoelectric transducing devices and reads images of three different colors at the same time. An image processing section, not shown, transforms a red, a green and a blue image signal to black (Bk), cyan (C), magenta (M) and yellow (Y) color data.

More specifically, in response to a scanner start signal synchronous to the operation of the color printer II, optics including the lamp 102 and mirrors 103*a* through 103*c* scans the document G to the left, as indicated by an arrow in FIG. 1. Every time the optics scans the document G, color data of one color is output. As a result, when the optics repeatedly scans the document G four consecutive times, color data of four colors are sequentially output. The color printer II sequentially forms images of four different colors in accordance with the color data while superposing them on each other, thereby completing a full-color image.

The color printer II includes a photoconductive drum or image carrier 1, an optical writing unit 22, a developing device implemented as a revolver 23, an intermediate image transferring device 26, and a fixing device 27. The drum 1 is rotatable counterclockwise, as viewed in FIG. 1, as indicated by an arrow. Arranged around the drum 1 are a drum cleaner 201, a discharge lamp 202, a charger 203, a potential sensor 204, a density pattern sensor 205, and an image transfer belt 261 included in the intermediate image transferring device 26. Also, one of four different developing sections arranged in the revolver 23 adjoins the drum 1.

In the color printer II, the drum 1 and revolver 23 may be implemented as a single process cartridge removable from the color printer II. The process cartridge may additionally include the drum cleaner 201, discharge lamp 202, charger 203, potential sensor 204, and density pattern sensor 205.

The optical writing unit 22 transforms the color data output from the color scanner I to an optical signal and optically writes a document image on the drum 1 with the optical signal, thereby forming a latent image. The writing unit 22 includes a semiconductor laser or light source 221, a laser driver, not shown, a polygonal mirror 222, a motor 223 for causing the polygonal mirror 222 to rotate, an f/θ lens 224, and a mirror 225.

The revolver 23 includes a Bk developing section 231K, a C developing section 231C, an M developing section 231M, a Y developing section 231Y, and a drive arrangement, which will be described later, that causes the revolver 23 to rotate counterclockwise, as viewed in FIG. 1, as indicated by an arrow. The Bk developing sections 231K through 231Y each include a rotatable sleeve and a rotatable paddle. The sleeve in rotation causes a developer deposited thereon in the form of a magnet brush to contact the surface of the drum 1 for thereby developing the latent image. The paddle in rotation scoops up the developer toward the surface of the sleeve while agitating it. The developer is a mixture of ferrite carrier and toner. The toner is charged to negative polarity while being agitated by the paddle together with the ferrite carrier.

A bias power source, not shown, applies a bias for development (oscillating bias voltage) to the sleeve to thereby bias the sleeve to a preselected potential relative to a metallic core included in the drum 1. The bias is a negative DC voltage Vdc biased by an AC voltage Vac. A background potential and an image potential lie between the maximum value and the minimum value of the oscillating bias potential. Consequently, an electric field alternating in direction is formed in a developing region where the sleeve faces the drum 1, causing the toner and carrier of the developer to strongly oscillate. The toner therefore flies toward the drum 1 away from the sleeve by overcoming electrostatic restriction and deposits on the latent image carried on the drum 1.

The maximum and minimum values of the oscillating bias voltage should preferably differ from each other by 0.5 kV to 5 kV. Also, the bias voltage should preferably have a frequency between 1 kHz and 10 kHz. The bias voltage may have a rectangular, a sinusoidal or a triangular waveform by way of example. While the DC voltage component of the bias voltage lies between the background potential and the image potential, as stated above, it should preferably be closer to the background potential in order to prevent the toner from depositing on the background of an image (fog).

When the oscillating bias voltage has a rectangular waveform, there should preferably be selected a duty ratio of 50%. A duty ratio refers to a ratio of the duration over which the toner tends to fly toward the drum 1 to a single period of the bias voltage. This successfully increases a difference between a peak value that drives the toner toward the drum 1 and the time mean of the bias voltage. In this condition, the toner moves more actively and faithfully deposits on the potential distribution of the latent image, thereby reducing granularity and enhancing resolution. Moreover, there can be reduced a difference between a peak value that drives the carrier, which is opposite in polarity to the toner, toward the drum and the time mean of the bias voltage. This reduces the movement of the carrier and therefore the probability that the carrier deposits on the background of the latent image.

In the illustrative embodiment, the Bk developing section 231K of the revolver 23 is located at a developing position adjoining the drum 1 when the copier body is in a standby state. On the start of copying operation, the color scanner I starts reading Bk color data out of the document G at a preselected timing. There also begin optical writing based on the color data and the formation of a corresponding latent image. Let a latent image derived from the Bk color data be referred to as a Bk latent image. This is also true with the other colors C, M and Y. Before the leading edge of the Bk latent image arrives at the Bk developing section 231K, the Bk sleeve of the developing section 231K is rotated to develop the Bk latent image with Bk toner. As soon as the trailing edge of the Bk latent image moves away from the developing position, the revolver 23 is rotated to bring the next developing section (usually C developing section 231C in the illustrative embodiment) to the developing position. This rotation completes at least before the leading edge of a latent image derived from the next color data arrives at the developing position. The revolver 23 will be described more specifically later.

The intermediate image transferring device 23 includes a belt cleaner 262 and a corona discharger (sheet transfer unit hereinafter) 263 in addition to the transfer belt 261 mentioned earlier. The transfer belt 261 is passed over a drive roller 264*a* and a plurality of driven rollers as well as over backup rollers 264*b* and 264*c*. A motor, not shown, causes the transfer belt 261 to turn via the drive motor 264*a*.

The belt cleaner 262 includes an inlet seal, a rubber blade, a discharge roller, and a mechanism for moving the inlet seal and rubber blade into and out of contact with the transfer belt 261. After the transfer of the Bk or first-color toner image from the drum 1 to the transfer belt 261, the above mechanism maintains the inlet seal and rubber blade released from the transfer belt 261 while the belt transfer of the second-, third and fourth-color toner images are under way. An AC-biased DC voltage or a DC voltage is applied to the sheet transfer unit 263. In this condition, the sheet transfer unit 263 collectively transfers a full-color image formed on the transfer belt 261 to a paper sheet or similar recording medium by corona discharge.

A sheet cassette 207 is disposed in the color printer II while sheet cassettes 30*a*, 30*b* and 30*c* are disposed in the sheet bank III. The sheet cassettes 207 and 30*a* through 30*c* each are loaded with a stack or paper sheets of particular size. Pickup rollers 28 and pickup rollers 31*a*, 31*b* and 31*c* are associated with the sheet cassette 207 and 30*a* through 30*c*, respectively. One of the pickup rollers 28 and 31*a* through 31*c* pays out a paper sheet of designated size from associated one of the sheet cassettes 207 and 30*a* through 30*c* toward a registration roller pair 29. A manual feed tray 21 is mounted on the right side of the printer II, as viewed in FIG. 1, for allowing the operator to feed OHP (OverHead Projector) forms, relatively thick sheets and so forth by hand.

In operation, when an image forming cycle begins, the drum 1 is driven counterclockwise while the transfer belt 261 is driven clockwise. While the transfer belt 261 is in rotation, a Bk, a C, an M and a Y toner image are sequentially transferred from the drum 1 to the transfer belt 261 in this order, completing a full-color image on the belt 261.

More specifically, to form the Bk toner image, the charger 203 uniformly charges the surface of the drum 1 to a negative potential of about −700 V. The semiconductor laser 221 exposes the charged surface of the drum 1 by raster scanning in accordance with a Bk color image signal. The exposed portions of the drum 1 loose the charge by an amount corresponding to the quantity of incident light, forming a Bk latent image. The Bk toner with negative charge deposited on the Bk sleeve contacts the Bk latent image, but does not contact the background where the charge is left. As a result, a Bk toner image identical with the Bk toner image is formed on the drum 1. The belt transfer unit 265 transfers the Bk toner image from the drum 1 to the transfer belt 261, which is moving at the same speed as the drum 1 in contact with the drum 1. Let the image transfer from the drum 1 to the transfer belt 261 be referred to as belt transfer.

The drum cleaner 201 removes the toner left on the drum 1 after the belt transfer to thereby prepare the drum 1 for the next image formation. The toner collected by the drum cleaner 201 is delivered to a waste toner tank, not shown, via a pipe not shown.

After the Bk image forming step, the color scanner I starts reading C image data out of the document G at a preselected timing. At the same time, the formation of a C latent image begins in accordance with the C image data. After the trailing edge of the Bk latent image has moved away from the developing position, but before the leading edge of the C latent image arrives at the developing position, the revolver 23 is rotated to locate the C developing section 31C at the developing position. In this position, the C developing section 31C develops the C latent image with C toner. As soon as the trailing edge of the C latent image moves away from the developing position, the revolver 23 is again rotated to bring the M developing section 231M to the developing position. This rotation also completes before the leading edge of an M latent image to be developed next arrives at the developing position.

An M and a Y toner image are formed in the same manner as the Bk and C toner images, but will not be described specifically in order to avoid redundancy. The Bk, C, M and Y toner images are sequentially transferred to the same surface of the transfer belt 261 one above the other, completing a full-color toner image.

When the image forming procedure described above beings, a paper sheet is fed from designated one of the sheet cassettes or from the manual feed tray and temporarily stopped by the registration roller pair 29. When the leading edge of the full-color toner image formed on the transfer belt 261 is about to reach the sheet transfer unit 263, the registration roller pair 29 drives the paper sheet such that the leading edge of the paper sheet meets the leading edge of the toner image. When the paper sheet superposed on the toner image arrives at the sheet transfer unit 263, the transfer unit 263 charges the paper sheet with the positive charge to thereby transfer the toner image from the transfer belt 261 to the paper sheet. Subsequently, a discharge, not shown, positioned at the left-hand side of the sheet transfer unit 263, as viewed in FIG. 1, discharges the paper sheet by AD+DC corona discharge. Consequently, the paper sheet is separated from the transfer belt 261 and then handed over to a belt conveyor 211.

The belt conveyor 211 conveys the paper sheet with the toner image to the fixing device 27, which includes a heat roller 271 controlled to a preselected temperature and a press roller 272. The heat roller 271 and press roller 272 fix the toner image on the paper sheet with heat and pressure. Thereafter, an outlet roller pair 32 drives the paper sheet or full-color copy out of the copier body to a copy tray, not shown, face up.

The drum cleaner 201, which is implemented as a brush roller or a rubber blade, removes the toner left on the drum 1 after the belt transfer. Subsequently, the discharge lamp 202 uniformly discharges the surface of the drum 1. Further, the previously mentioned mechanism brings the rubber blade of the belt cleaner 262 into contact with the transfer belt 261 for thereby cleaning the surface of the belt 261.

Figure 2:
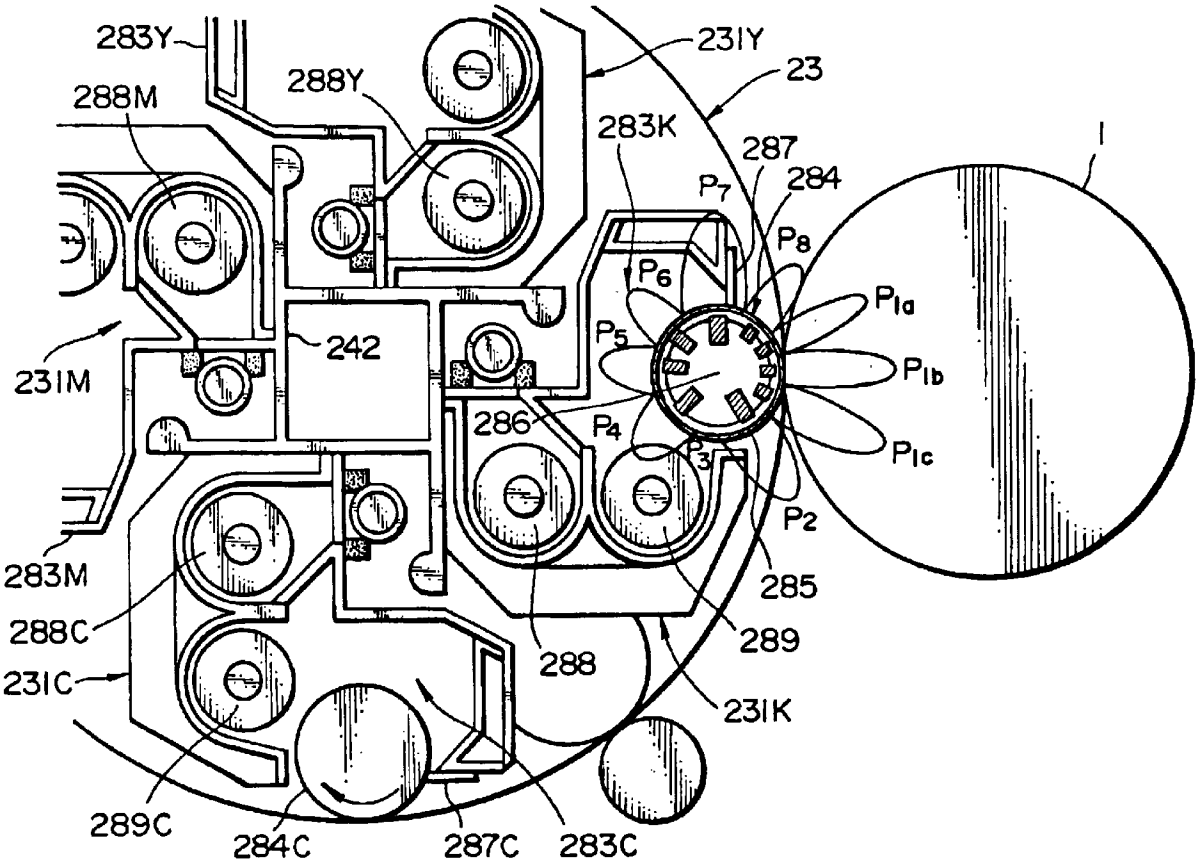
FIG. 2 is a fragmentary view showing a revolver or developing unit included in the illustrative embodiment.

Reference will be made to FIG. 2 for describing the revolver 23 in detail. As shown, the revolver 23 includes a hollow, rectangular stay 242 supported by opposite end walls, not shown, included in the revolver 23. The stay 242 supports the developing sections 231K through 231Y. The developing sections 231K through 231Y respectively include cases 283K through 283Y that are identical in configuration. The cases 283K through 283Y each store the respective developer, i.e., toner and carrier mixture. In the position shown in FIG. 2, the Bk developing section 231k storing a black toner and carrier mixture is located at the developing position adjoining the drum 1. The Y developing section 231Y, M developing section 231M and C developing section 231C sequentially follow the Bk developing section 231K in the counterclockwise direction as viewed in FIG. 2. The developing sections 231Y through 231C respectively store a yellow toner and carrier mixture, a magenta toner and carrier mixture, and a cyan toner and carrier mixture.

Because the developing sections 231K through 231Y are identical in construction except for the configuration of a magnet roller, the following description will concentrate on the developing section 231K by way of example. In FIG. 2, The other developing sections 231M, 231C and 231Y are simply distinguished from the developing section 231K by suffixes M, C and Y, respectively. In the illustrative embodiment, only the Bk developing section 231K includes a magnet roller having auxiliary magnetic poles, which help a main magnetic pole generate a magnetic force. Magnet rollers included in the other developing sections 231C through 231Y each have a relatively small attenuation ratio or have a main magnetic pole whose half width is relatively great as conventional.

As shown in FIG. 2, the case 283K accommodates a developing roller 284 that faces the drum 1 to thereby form the developing region stated earlier. The developing roller 284 includes a hollow, cylindrical sleeve 285 formed of aluminum, brass, stainless steel, conductive resin or similar nonmagnetic material. A drive mechanism, not shown, causes the sleeve 285 to rotate clockwise as viewed in FIG. 2.

In the illustrative embodiment, the drum 1 has a diameter of 90 mm and rotates at a linear velocity of 200 mm/sec. The sleeve 285 has a diameter of 30 mm and rotates at a linear velocity of 240 mm/sec. Therefore, the linear velocity ratio of the sleeve 285 to the drum 1 is 1.2. The drum 1 and sleeve 285 are spaced from each other by a gap for development of 0.4 mm. While the sleeves of the other developing sections 231C, 231M and 231Y should preferably have a diameter of 29.9 mm and spaced from the drum 1 by a gap of 0.45 mm, they may also have a diameter of 30 mm and may also be spaced by a gap of 0.4 mm, if desired.

The sleeve 285 accommodates a magnet roller 286 for causing the developer deposited on the sleeve 285 to rise in the form of a magnet brush. More specifically, carrier particles forming part of the developer rise on the sleeve 285 in the form of chains along the magnetic lines of force, which are normal to the magnet roller 286. Charged toner particles forming the other part of the developer deposit on such carrier particles, constituting a magnet brush. The sleeve 285 conveys the magnet brush in the direction of rotation thereof.

Figure 3:
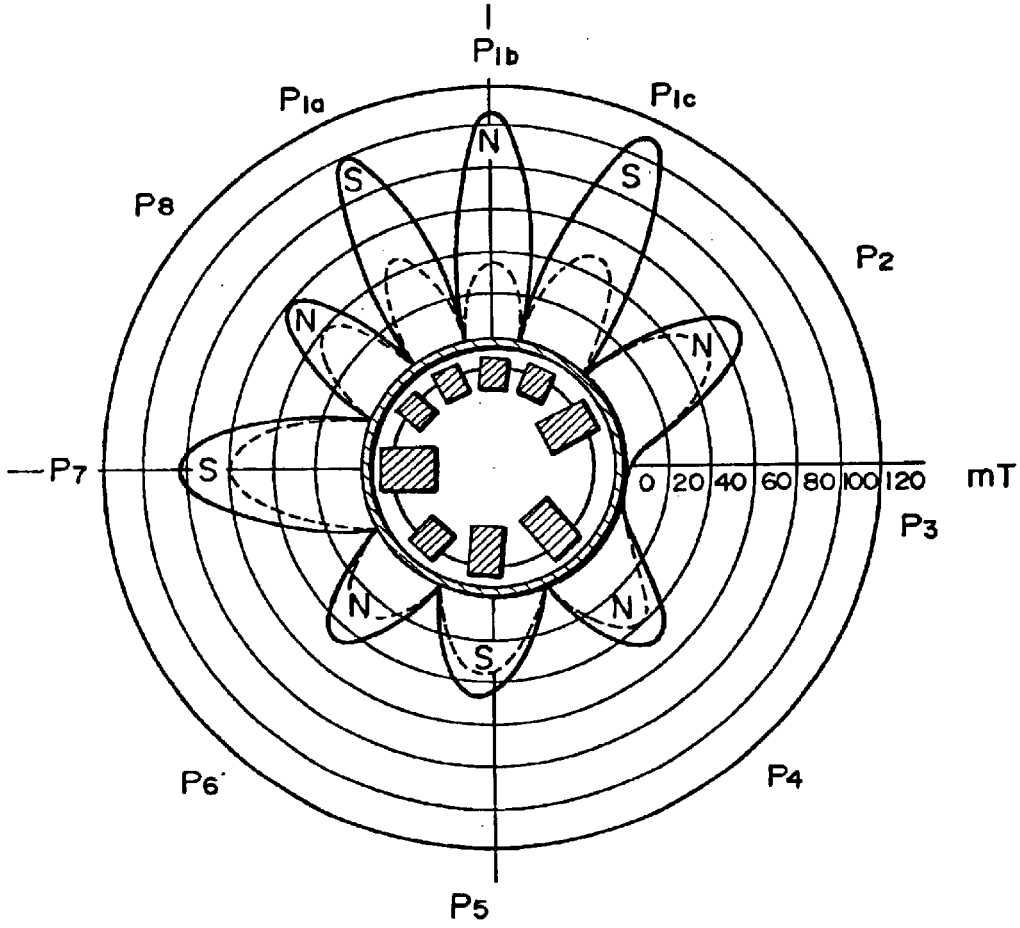
FIG. 3 is a chart showing a magnetic force distribution and the sizes of magnetic forces particular to a developing roller included in the revolver.

The magnet roller 286 has a plurality of magnetic poles. Specifically, as best shown in FIG. 3, the magnet roller 286 has a main pole P1*b* for causing the developer to rise in the developing region and auxiliary poles P1*a* and P1*c* for helping the main pole P1*b* generate a magnetic force. Further, the magnet roller 286 has poles P4 and P5 for scooping up the developer onto the sleeve 285, poles P6, P7 and P8 for conveying the developer deposited on the sleeve 285 to the developing region, and poles P2 and P3 for conveying the developer in the region following the developing region. The poles P1*a* through P8 each extend in the radial direction of the sleeve 285. FIGS. 4A and 4B respectively show various factors particular to an FeNdB bond, magnet roller assigned to the black toner and those of a magnet roller assigned to the toner of the other colors with respect to a diameter of 30 mm.

In the illustrative embodiment, the magnet roller 286 has ten poles in total. Alternatively, the magnet roller 286 may have two additional poles between the pole P3 and a doctor blade 287, which will be described later, in order to enhance scoop-up of the developer and faithful reproduction of a black, solid image. Further, the ten poles may be reduced to eight poles in order to simplify the configuration and lower the cost.

As shown in FIGS. 2 and 3, the poles P1*a*, P1*b* and P1*c* are sequentially arranged in this order from the upstream side in the direction of rotation of the sleeve 285, and each is formed by a magnet having a relatively small cross-sectional area. While such magnets are formed of rare earth metal, they may alternatively be formed of samarium alloy, particularly samarium-cobalt alloy. Typical of rare earth metal alloy is iron-neodymium-boron alloy that provides a magnet with the maximum energy product of 358 kJ/m$^3$; an iron-neodymium-boron alloy bond magnet has the maximum energy product of 80 kJ/m$^3$ or so. These magnets can therefore exert a required magnetic force, as measured on the surface of the sleeve 285, even when they are reduced in size to a noticeable degree. By contrast, a conventional ferrite magnet and a conventional ferrite bond magnet respectively have the maximum energy product of 36 kJ/m$^3$ or so and the maximum energy product of 20 kJ/m$^3$ or so.

If the diameter of the sleeve 285 can be increased, then use may be made of ferrite magnets or ferrite bond magnets. In such a case, the tips of the magnets facing the sleeve 285 may be tapered to reduce the half width and therefore to provide a tangential flux density with a preselected variation ratio. At this instant, a leakage magnetic field should preferably be reduced, as will be described specifically later. It is to be noted that a half width refers to the angular width of a point whose magnetic force is one-half of the maximum magnetic force (peak) of a magnetic force distribution curve in the normal direction. For example, if an N-pole magnet has the maximum, magnetic force of 120 mT (millitesla) in the normal direction, then a half value is 60 mT.

The magnets each having a relatively small sectional area as shown and described may be replaced with a single, molded magnet roller. Further, only the poles P1*a* through P1*c* may be molded independently of each other and then assembled together or may be molded integrally with each other, in which case the other magnets will be molded integrally with each other. As for shape, each magnet of the magnet roller may have a square, sectoral or annular section. Also, sectoral magnets maybe adhered to a single magnet roller shaft.

In the illustrative embodiment, the main pole P1*b* and poles P4, kP6, P8, P2 and P3 are N poles while the auxiliary poles P1*a* and P1*c* and poles P5 and P7 are S poles. As FIG. 3 indicates, in the illustrative embodiment, the magnet forming the main pole P1*b* exerts a magnetic force of 85 mT in the normal direction, as measured on the surface of the sleeve 285. Experiments showed that if the magnet forming the auxiliary pole P1*c* downstream of the main pole P1*b* in the direction of rotation of the sleeve 285 had a magnetic force of 60 mT or above, carrier deposition and other defects did not occur. Carrier deposition was observed when the magnetic force was less than 60 mT. To increase a tangential magnetic force that relates to carrier deposition, it is necessary to increase the magnetic forces of the poles P1*b* and P1*c*. However, carrier deposition can be obviated if the magnetic force of each one of the poles P1*b* and P1*c* is increased to a sufficient degree. The magnets forming the poles P1*a*, P1*b* and P1*c* each were 2 mm wide, in which case the pole P1*b* had a half width of 160. By further reducing the width of the magnets, it was possible to further reduce the half width. For a 1.6 mm wide magnet, the half width was 12°.

The auxiliary poles P1*a* and P1*c* are omissible if the main pole P1*b* exerts a sufficient magnetic force.

Referring again to FIG. 2, the doctor blade 287 mentioned earlier faces the sleeve 285 for regulating the amount of the developer, which is conveyed to the developing region by the sleeve 285. A doctor gap of 0.4 mm is formed between the doctor blade 287 and the sleeve 285. A first screw 288 conveys part of the developer blocked by the doctor blade 287 from the rear to the front of the case 283K in the axial direction of the screw 288. A second screw 289 conveys the developer from the front to the rear of the case 283K. A toner content sensor, not shown, is mounted on the case 283K below the second screw 289 for sensing the toner content of the developer present in the case 283K.

Figure 5:
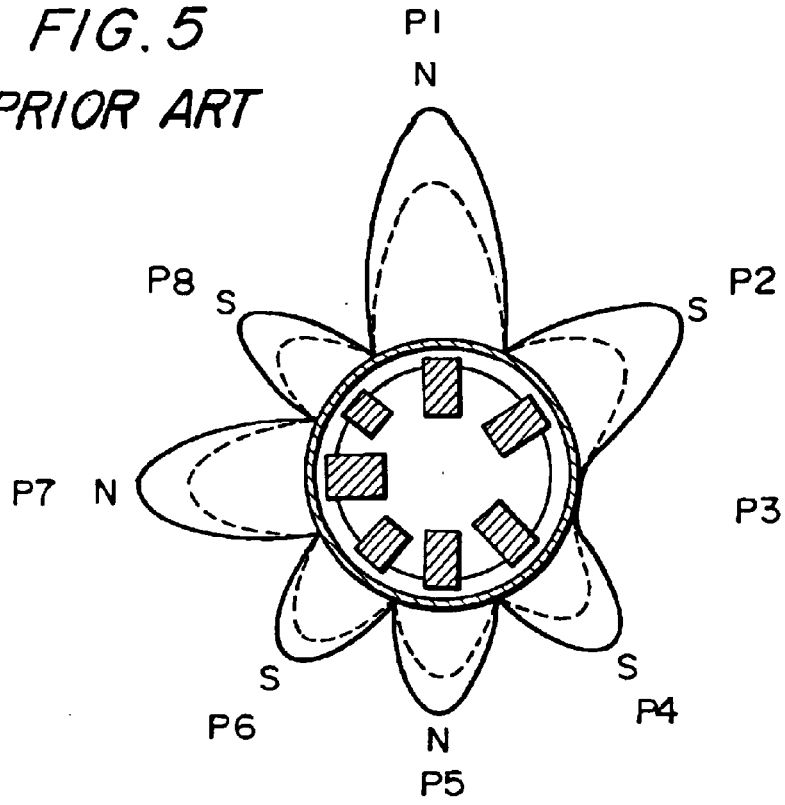
FIG. 5 PRIOR ART
FIG. 5 shows the magnetic force distribution of a developing roller having a conventional structure and assigned to color toner other than black toner.

The attenuation ratio of the flux density in the normal direction will be described specifically with reference to FIG. 3, which shows a normal magnetic force pattern. In FIG. 3, solid lines are representative of a flux density distribution as measured on the surface of the sleeve 285. Dashed lines are representative of a flux density distribution as measured at points spaced from the surface of the sleeve 285 by 1 mm. For comparison, FIG. 5 shows the flux density distributions of a conventional magnet roller assigned to each of the other colors. For measurement, use were made of a gauss meter HGM-8900S and a probe TS-10A available from ADS and a circular chart recorder.

The main pole P1*b* had a flux density of 108.0 mT in the normal direction on the surface of the sleeve and a flux density of 34.1 mT at a point spaced from the sleeve surface by 1 mm; the flux density varied by 73.9 mT. In this case, the attenuation ratio of the flux density in the normal direction is 68.4%. An attenuation ratio refers to a value produced by dividing a difference between the peak value of the flux density on the surface of the sleeve 285 and that of the flux density at the point spaced from the sleeve surface by 1 mm by the peak value of the flux density on the sleeve surface. When the peak normal magnetic field of the main pole P1*b* is 108.0 mT, the half value is 54 mT and the half width is 22*c*. It was found that half widths greater than 22° resulted in defective images. The half width available with the conventional magnet roller in a range that insures the desired magnetic force of the main pole on the sleeve surface is not greater than 25°.

The auxiliary pole P1*a* upstream of the main pole P1*b* had a flux density of 107.4 mT on the sleeve surface in the normal direction and a flux density of 45.6 mT at the point spaced from the sleeve surface by 1 mm; the flux density varied by 61.8 mT. In this case, the flux density in the normal direction attenuated by 57.5%. The other auxiliary magnet P1*c* downstream of the main pole P1*b* had a flux density of 104.6 mT on the sleeve surface in the normal direction and a flux density of 44.8 mT at the point spaced from the sleeve surface by 1 mm; the flux density varied by 59.8 mT. In this case, the flux density in the normal direction attenuated by 57.1%.

In the illustrative embodiment, only part of the magnet brush formed on the sleeve 285 formed by the main pole P1*b* contacts the drum 1 and develops a latent image formed thereon. When measurement was effected without the drum 1 contacting the above magnet brush, the magnet brush was about 1.5 mm long. This magnet brush was shorter than a magnet brush (about 3 mm) formed by the conventional magnet roller and was more dense than the latter. Such a magnet brush in the developing region was found to be short and dense for the same doctor gap as conventional, i.e., for the same amount of developer passing the doctor blade as conventional. This will also be understood with reference to FIG. 3. Specifically, as shown in FIG. 3, the flux density in the normal direction noticeably decreases at the point spaced from the sleeve surface by 1 mm. As a result, the carrier particles cannot form brush chains at the above point and therefore allow a short, dense magnet brush to be formed on the sleeve surface.

Figure 6:
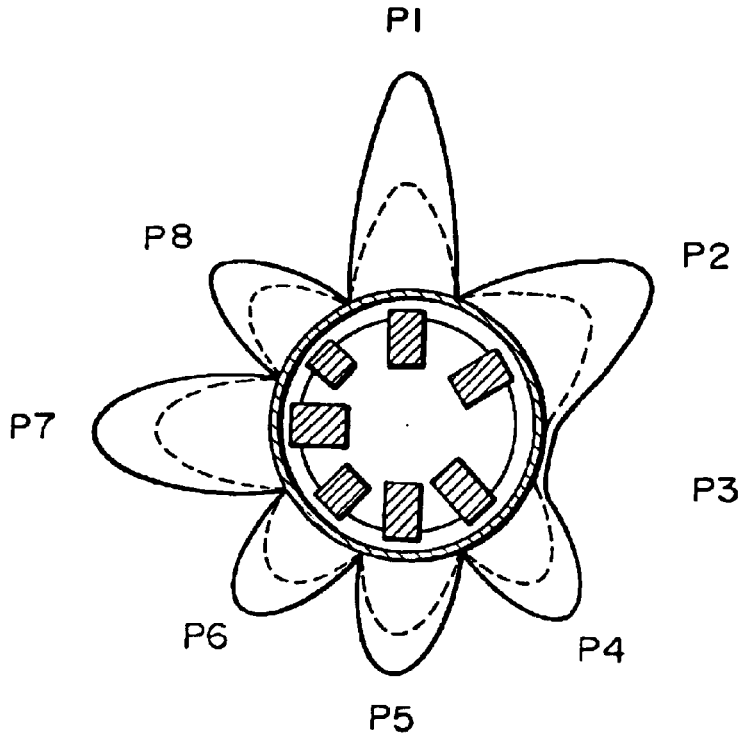
FIG. 6 shows the magnetic distribution of a magnet roller lacking auxiliary magnetic poles together with the sizes of magnetic forces.

On the other hand, the flux density available with the main pole of the magnet roller shown in FIG. 6 was 107.8 mT on the sleeve surface or 76.7 mT at the point spaced from the sleeve surface by 1 mm; the flux density varied by 31.1 mT. In this case, the attenuation ratio of the flux density in the normal direction is 28.8%.

In the illustrative embodiment, a magnet roller with auxiliary poles and a magnet roller with the conventional configuration are assigned to the Bk developing section 231K and each of the other developing sections 231C, 231M and 231Y, respectively, as stated above. However, the attenuation ratio of 40% or above or the half width of 22° or below required of the main pole is achievable without resorting to the auxiliary poles. A magnet roller with such a new configuration may be assigned to the Bk developing section 231K (in which case the conventional configuration will be assigned to the other developing sections) or to the developing sections other than the Bk developing section 231K (in which case the configuration with the auxiliary poles will be assigned to the Bk developing section 231K.

A modification of the illustrative embodiment that implements the attenuation ratio of 40% or above or the half width of 22° or below required of the main pole will be described hereinafter. The modification is practicable with the same sleeve configuration and revolver configuration as the embodiment described above.

In the modification, a magnet roller has a magnet P1 that forms a main pole P1 for causing the developer to rise on the sleeve at the developing region. Further, the magnet roller has a magnet P4 for scooping up the developer to the sleeve, magnets P5 and P6 for conveying the developer scooped up to the developing region, and magnets P2 and P3 for conveying the developer in the region following the developing region. The magnet P1, like the magnet with the auxiliary magnets of the previous embodiment, is formed of rare earth metal alloy, but may be formed of, e.g., samarium alloy, if desired. The modification is identical with the illustrative embodiment in that a magnetic force of 60 mT or above obviates carrier deposition and other defects, and in that the half width of the magnet P1 is 22° for a width of 2 mm or 16° for a width of 1.6 mm.

As FIG. 6 indicates, in the magnet roller of the modification, the main pole P1 had a flux density of 85 mT on the sleeve surface in the normal direction or a flux density of 39.5 mT at the point spaced from the sleeve surface by 1 mm; the flux density varied by 45.5 mT. In this case, the attenuation ratio of the flux density in the normal direction is 53.5%. In the modification, only part of the magnet brush corresponding to the main pole P1 contacts the drum 1 and develops a latent image formed thereon.

The illustrative embodiment and modification thereof differ from each other as to the structure of the magnet roller included in each of the Bk, C, M and Y developing sections. It is therefore preferable to mount a weight on any one of the developing sections expected to be light weight for thereby balancing the rotation of the revolver.

Figure 7B:
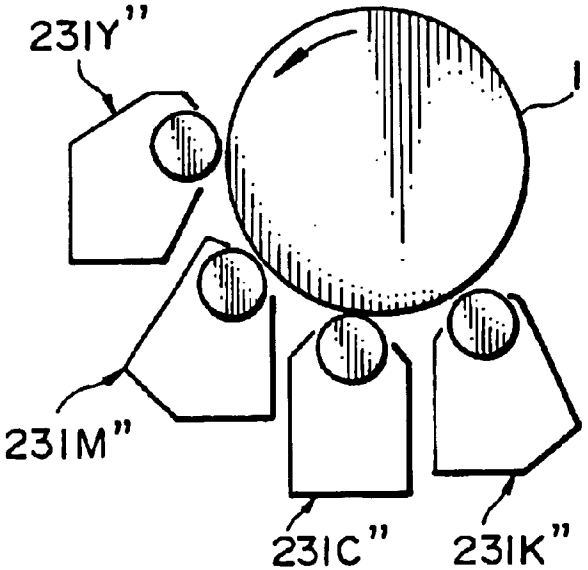
FIG. 7B shows a specific arrangement of a photoconductive drum and four independent developing units also available with the illustrative embodiment.
Figure 7A:
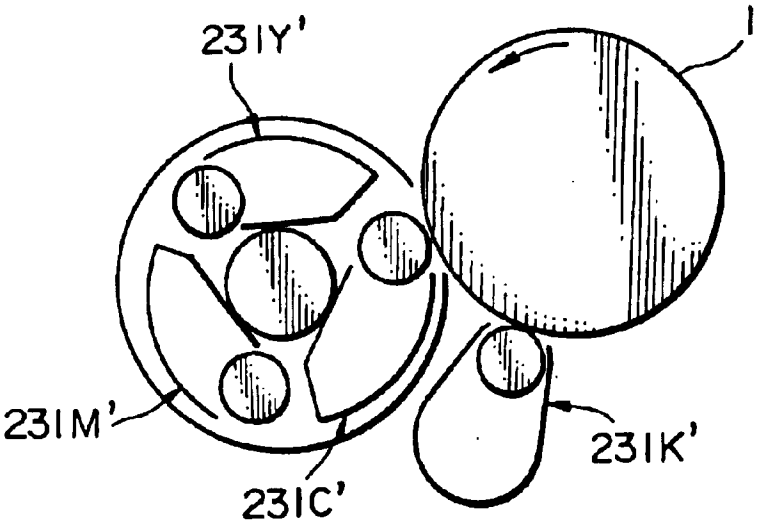
FIG. 7A shows a specific arrangement of a photoconductive drum, a three-color revolver and a stand-alone black developing unit available with the illustrative embodiment.

As shown in FIG. 7A, the revolver may include the developing sections other than the Bk developing section, in which case the Bk developing unit will be fixed in place outside of the revolver. Further, as shown in FIG. 7B, all the developing units may be constructed independently of each other and fixedly arranged around the drum 1.

As stated above, the illustrative embodiment and modification thereof achieve the following unprecedented advantages. By assigning a magnet roller with a new configuration to a developing unit or section that needs higher reproducibility than the others, it is possible to reduce the cost of an image forming apparatus. In a usual developing device made up of a Bk, a C, an M and a Y developing units, it is preferable from the image quality and cost standpoint to assign a developing unit in which a main pole has a flux density of 40% or above in the normal direction or a half width of 22° or below to Bk and to assign a developing unit in which the attenuation ratio is 30% or less or the half width is 25° or above to the other colors.

When all the developing units are provided with the magnet roller having the new configuration, it is preferable from the image quality and cost standpoint that the magnet roller of the Bk developing unit has auxiliary poles while the magnet rollers of the other developing units do not have any auxiliary pole.

Assume that the Bk developing section is implemented as a stand-alone unit while the other developing sections are constructed into a single revolver. Then, when the magnet roller with the new configuration is assigned to the Bk developing unit, it is easy to balance the developing units and to accurately form a development gap for the Bk developing unit. When all the developing units, including the Bk developing unit, are constructed into a single revolver, the rotation of the revolver can be desirably balanced if the weights of the developing units are matched.

Further, assume that the development gap assigned to the Bk developing unit is smaller than the gaps assigned to the other developing units. Then, when the magnet roller with the new configuration is included in the Bk developing unit, there can be reduced the causes of defective images for thereby improving image density and promoting the faithful reproduction of low-contrast images. To promote easy design and production, it is desirable to provide the Bk developing unit with a roller diameter greater than the roller diameter of the other developing units.

Figure 8:
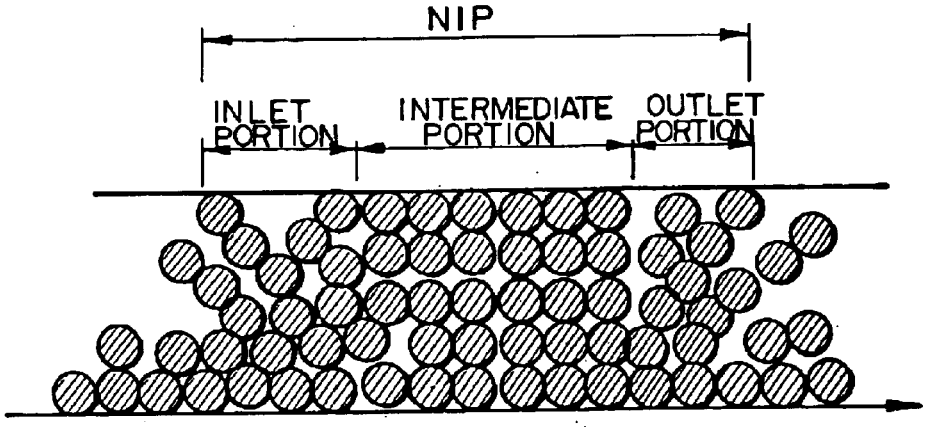
FIG. 8 PRIOR ART
FIG. 8 is a sketch showing a magnet brush formed at a nip for development by a conventional magnet roller.

An alternative embodiment of the present invention directed mainly toward the second object stated earlier will be described hereinafter. To better understand the alternative embodiment, how a magnet brush moves in a developing region where it contacts an image carrier will be described first. Toner particles deposited on carrier particles, which form a magnet brush, contact a photoconductive drum or image carrier to thereby develop a latent image formed on the drum. At this instant, the amount of toner to move from the carrier particles toward the drum increases with an increase in an electric field for development and with a decrease in the residual electric field of the carrier particles. As shown in FIG. 8, toner and carrier particles are expected to behave at a nip for development, which is substantially coincident with the developing region in the case of contact development, as follows.

(1) At the inlet portion of the nip where the magnet brush has just risen, toner particles cover major part of carrier particles and therefore have a strong developing force. However, the magnet brush moves so actively due to a high voidage, the amount of carrier particles to contact the drum and the electric field noticeably fluctuate.

(2) At the intermediate portion of the nip, the magnet brush contacts the drum in a stable amount while yielding itself. The electric field is stable also. Therefore, the residual charge of the carrier is low while the developing force is strong.

(3) At the outlet portion of the nip, the amount of toner particles on the carrier particles decreases. This, coupled with the residual charge, lowers the developing force. In addition, the magnet brush starts falling down. At this instant, a force that rubs the drum is generated to sweep off the toner particles deposited on the drum.

The inlet portion and intermediate portion of the nip stated above contribute to development. Particularly, by narrowing the inlet portion, it is possible to reduce the deposition of the carrier particles on the drum and therefore to reduce irregularly in the amount of toner particles to deposit on the drum. Further, by narrowing the end portion of the nip, it is possible to reduce the probability that the magnet brush sweeps off the toner particles deposited on the drum.

Figure 9:
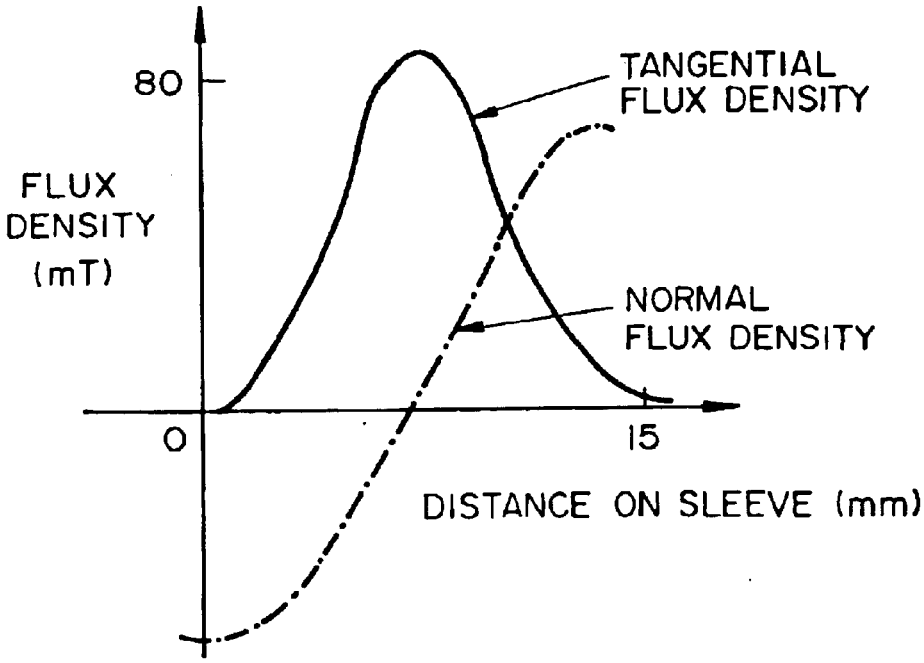
FIG. 9 PRIOR ART
FIG. 9 is a graph showing waveforms representative of flux densities particular to the conventional magnet roller.
Figures 10, 11:
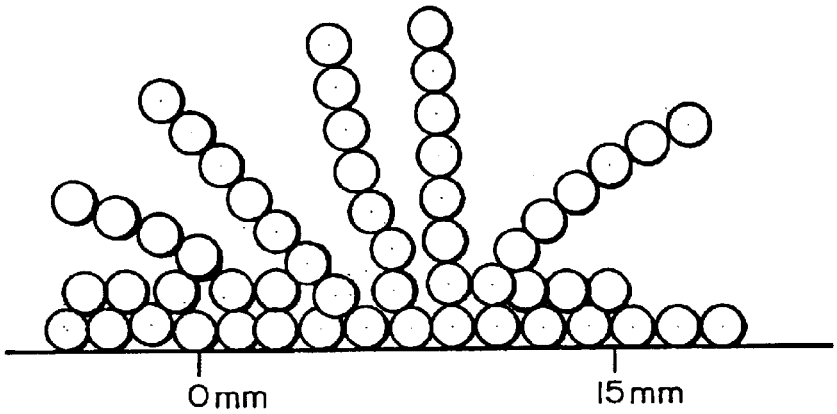
FIG. 10 PRIOR ART
FIG. 10 demonstrates how the magnet brush rises and then falls in relation to the graph of FIG. 9.
FIG. 11 is a table listing the results of functional estimation of granularity and local omission.

The consecutive conditions stated above will be described more specifically with reference to FIGS. 9 and 10. FIG. 9 shows flux density distributions in the normal direction and tangential direction available with the main pole of the conventional magnet roller. FIG. 10 is a sketch showing how the magnet brush is formed. As shown, the magnet brush tilts when the flux density $B_\theta$ in the tangential direction is high, and falls down practically flat at the peak of the flux density $B_\theta$. The flux density $B_\theta$ decreases with an increase in the flux density $B_\gamma$ in the normal direction. As a result, the magnet brush starts rising and contacts the drum. In a static condition, the magnet brush starts rising at an angle of $\theta_A$ that is expressed as:

$$\theta_A = \mathrm{Tan}^{-1}(B_\gamma / B_\theta)$$

In practice, at the inlet portion of the nip, the magnet brush does not start rising in a body due to the length of the magnet brush and the distribution of the developer that are not uniform. When the flux density $B_\theta$ decreases, the magnet brush fully rises and contacts the drum in the intermediate portion of the nip. Subsequently, as the flux density $B_\theta$ rises, the magnet brush starts falling down at the outlet portion of the nip.

Japanese Patent No. 2773151, for example, teaches an implementation for obviating defective images ascribable to the condition of contact of the magnet brush with the drum at positions preceding and following the intermediate portion of the nip, as stated earlier. The implementation consists in locating the peak (30 gauss/degree) of the variation of the magnetic field component (flux density) in the tangential direction in the developing region. The above document describes that such a configuration allows carrier particles to sufficiently fall down at the above positions. Theoretically, if the developing region is relatively broad, it may be possible to form portions where the magnetic force density component noticeably varies at opposite ends of the developing region while stabilizing the variation of the magnetic force density at the intermediate portion. In practice, however, the developing region available with an image forming apparatus of the type using a toner and carrier mixture is so narrow, it is difficult to locate the peak of the flux density in the tangential direction at opposite ends of the developing region. Moreover, a decrease in the diameter of the sleeve results in a decrease in the distance for an angle of 1 degree on the surface of the sleeve, so that the fall-down of the carrier particles has little effect, as discussed earlier.

The illustrative embodiment will be described specifically hereinafter. The illustrative embodiment is also practicable with the construction described with reference to FIGS. 1 through 3.

A prerequisite with the developing device shown in FIGS. 1 through 3 for narrowing the inlet portion of the developing region or nip is that the magnet brush rises in a body. Another prerequisite is that the distance between the point where the magnet brush rises and the point where it contacts the drum be reduced. Assume that the flux density in the tangential direction varies by an amount $dB_\theta$ at the upstream side of the intermediate portion of the developing region.

Then, the ratio of the variation of the above amount $dB_\theta$ to the distance $x=\gamma\cdot\theta$ on the surface of the sleeve has an absolute value of $|dB_\theta/(r\cdot d\theta)|$.

A magnet roller included in a conventional black-and-white image forming apparatus has a main pole whose flux density in the tangential direction varies by about 20 T/m in maximum value, so that a nip is easily formed. A magnet roller different from the magnet roller 284, FIG. 2, as to the maximum variation of the flux density in the tangential direction was mounted on the same image forming apparatus in order to estimate granularity and the omission of the trailing edge of an image. FIG. 11 is a table listing the results of estimation. In FIG. 11, rank 1 shows that granularity and/or local omission was conspicuous, while rank 5 shows that granularity and/or local omission did not occur at all. Rank 3 shows that granularity and/or local omission was acceptable for ordinary users, but was not accepted by designers or similar experts needing high-quality images. Rank 4 shows that the granularity and/or local omission was acceptable even for experts.

Figure 12:
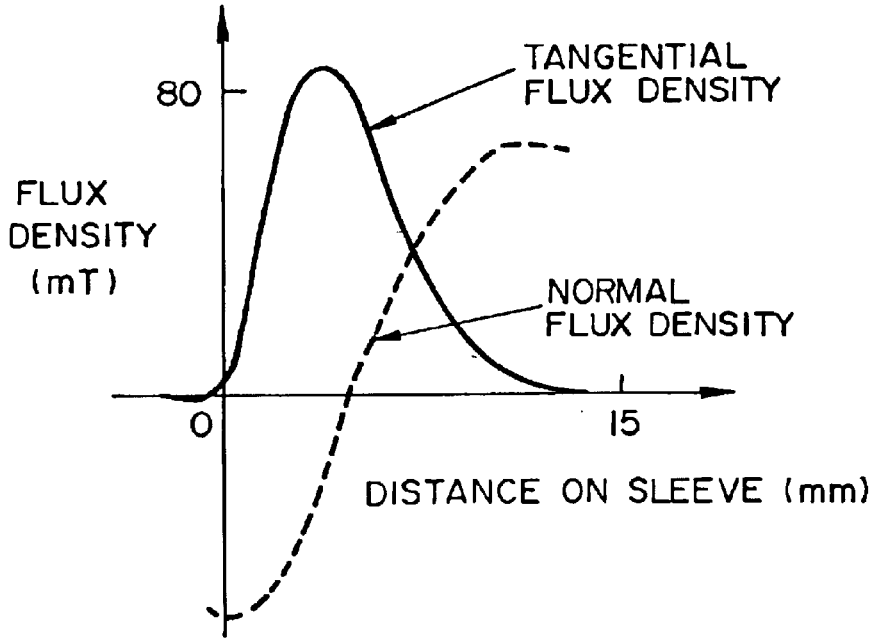
FIG. 12 is a graph showing waveforms representative of flux densities available when the variation ratio of the flux density in the tangential direction formed by a main magnetic pole has a maximum value positioned upstream of the center of a developing region.
Figure 13:
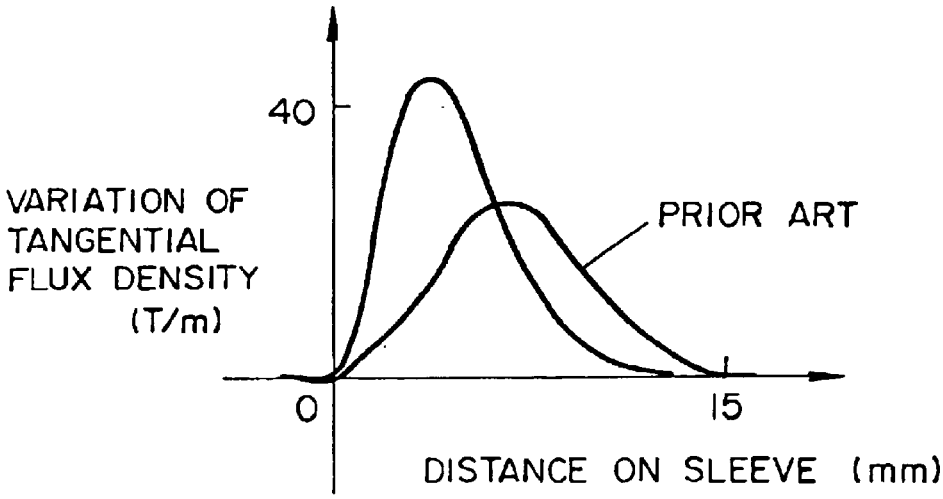
FIG. 13 is a graph comparing the illustrative embodiment and the conventional configuration of FIG. 5 with respect to the variation of the flux density in the tangential direction.
Figures 14, 15:
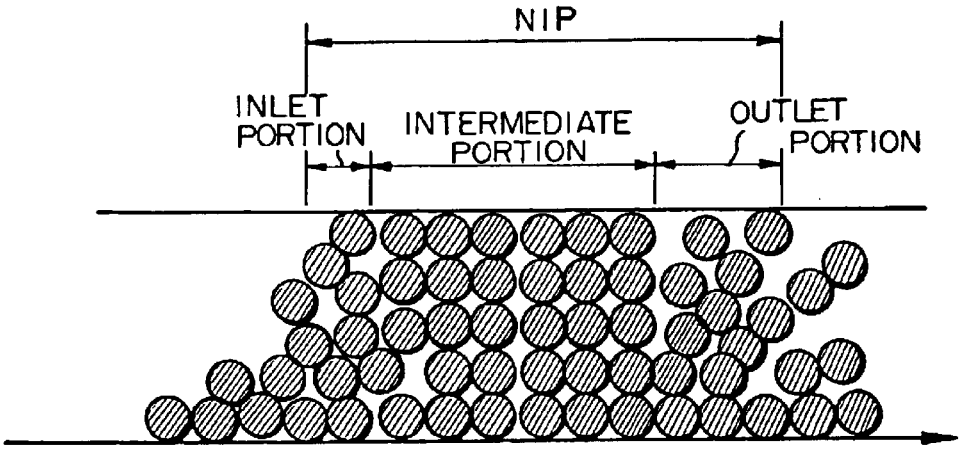
FIG. 14 is a sketch showing a magnet brush formed at the nip by the configuration of FIG. 5.
FIG. 15 is a table listing the results of functional estimation of granularity and local omission.

As FIG. 11 indicates, when the maximum variation of the flux density in the tangential direction is 40 T/m, which is double the conventional variation or more, image quality, particularly granularity, is obviously improved. This is because a sharp decrease in the flux density in the tangential direction allows the magnet brush to sharply rise and reduces granularity. FIG. 12 shows a specific waveform representative of the flux density distribution at the main pole of the magnet roller unique to the illustrative embodiment. FIG. 13 shows the variation of the flux density in the tangential direction also particular to illustrative embodiment for comparison with the conventional magnet roller. FIG. 14 shows the configuration of the magnet brush (carrier particles) formed at the nip.

Figure 16:
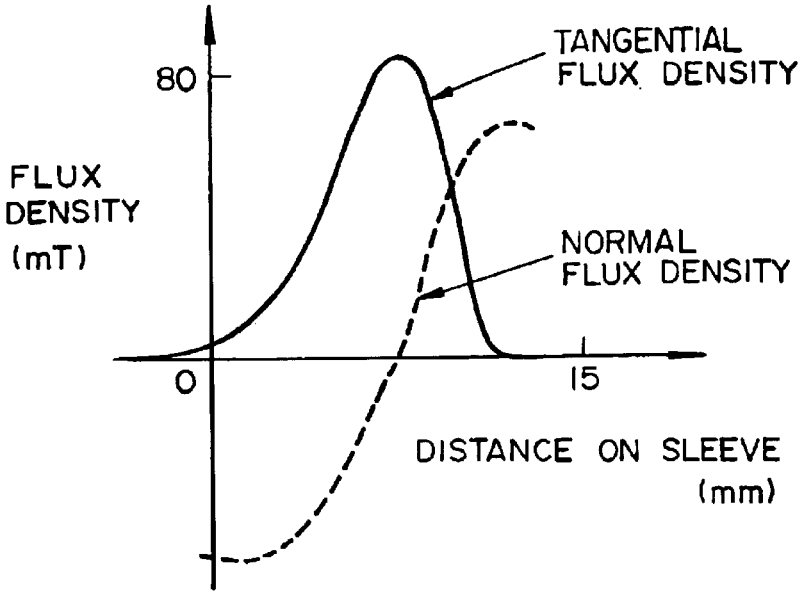
FIG. 16 shows waveforms representative of flux density distributions available when the variation ratio of the flux density in the tangential direction has a maximum value positioned downstream of the center of the developing region.
Figure 17:
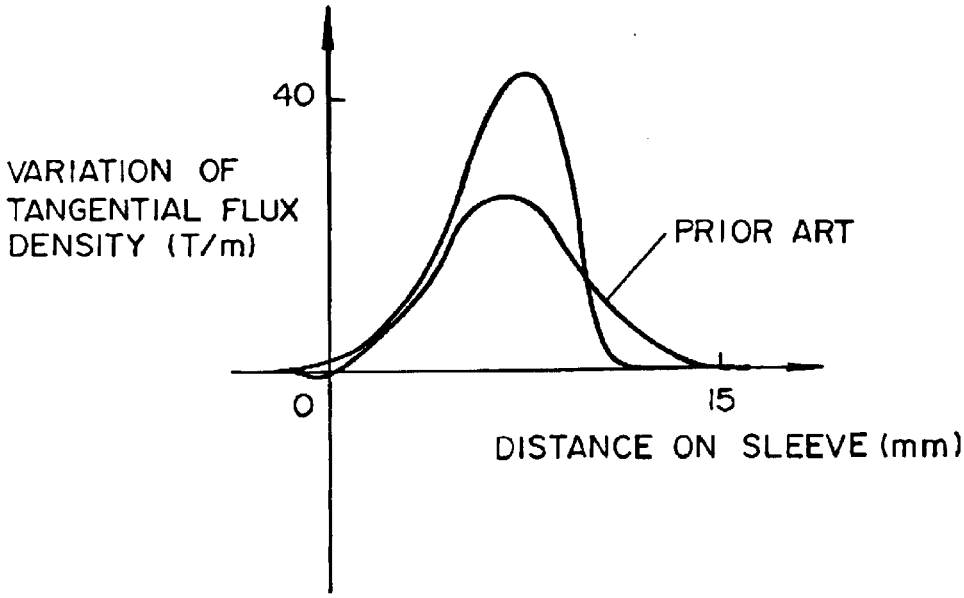
FIG. 17 is a graph comparing the illustrative embodiment and the conventional configuration with respect to the variation of the flux density in the tangential direction in relation to FIG. 16.
Figures 18, 19:
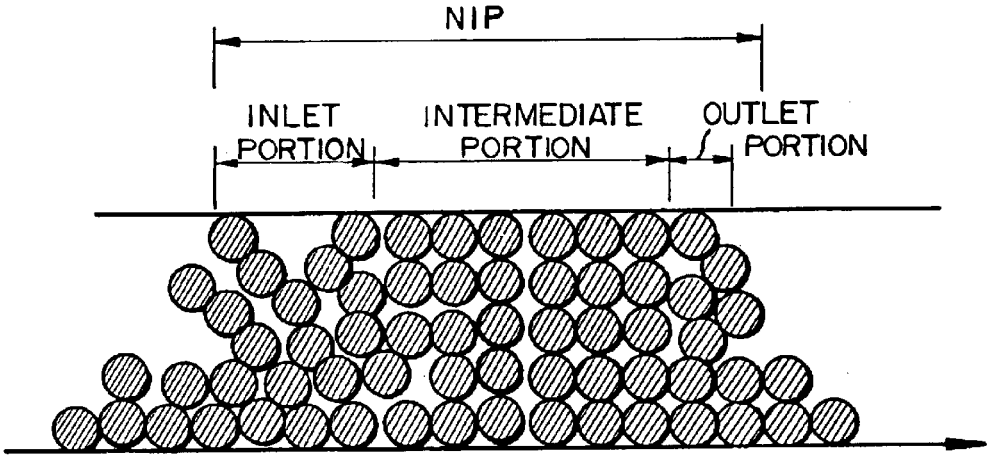
FIG. 18 is a sketch showing a magnetic brush formed at the nip in relation to FIG. 16.
FIG. 19 is a table listing the results of estimation of granularity and local omission.

Assume that the flux density in the tangential direction varies by an amount $dB_\theta$ at the downstream side of the intermediate portion of the developing region in the same manner as at the upstream side. Then, the ratio of the variation of the above amount $dB_\theta$ to the distance $x=\gamma\cdot\theta$ on the surface of the sleeve has an absolute value of $|dB_\theta/(r\cdot d\theta)|$, as stated earlier. As shown in FIG. 15, estimation executed in the same manner as at the upstream side showed that local omission was obviously improved when the maximum value of the variation of the flux density in the tangential direction was 40 T/m. This is because a sharp increase in the flux density in the above direction allows the magnet brush to sharply fall down and thereby reduces the distance between the point where the brush starts leaving the drum and the point where it falls practically flat. Consequently, the magnet brush sweeps the drum little and reduces local omission. FIG. 16 shows a specific waveform representative of the flux density distribution at the main pole of the magnet roller unique to the illustrative embodiment. FIG. 17 shows the variation of the flux density in the tangential direction also particular to illustrative embodiment for comparison with the conventional magnet roller. FIG. 18 shows the configuration of the magnet brush (carrier particles) formed at the nip.

FIG. 19 shows the results of estimation of granularity and local omission effected at both sides of the nip substantially toward the center of the nip. As shown, the maximum value of 40 T/m of the variation of the flux density in the tangential direction improved both granularity and local omission.

Figure 20:
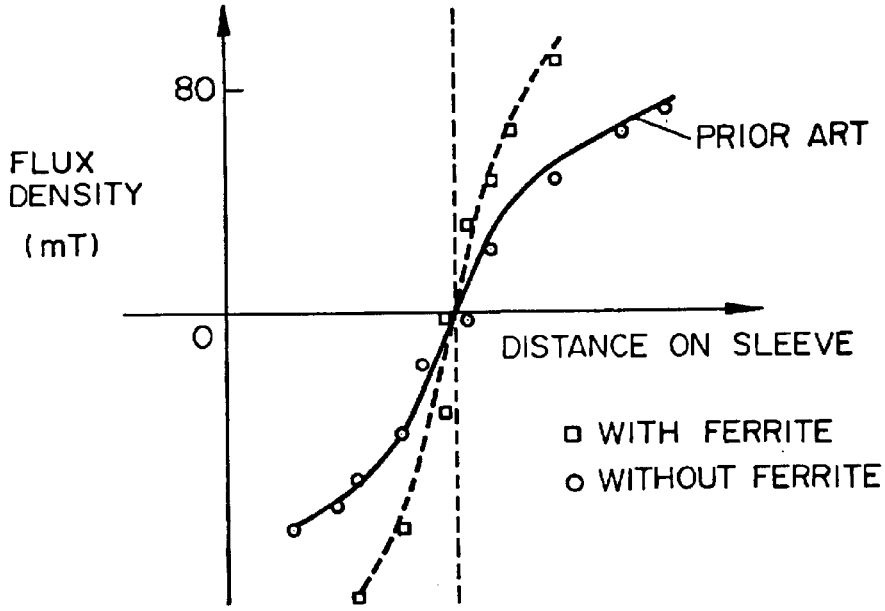
FIG. 20 shows waveforms representative of flux density distributions available when the variation ratio of the flux density in the tangential direction has a maximum value positioned at the center of the developing region.
Figure 21:
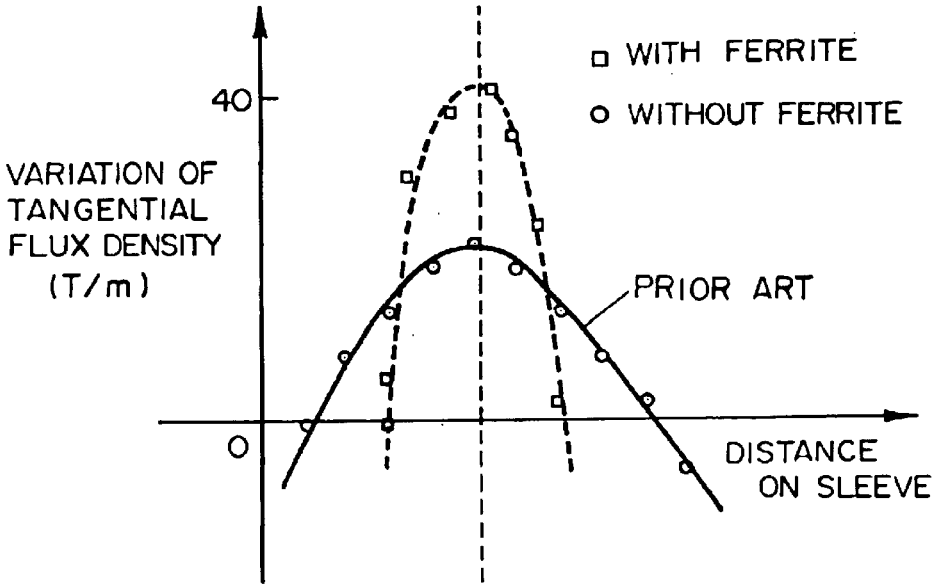
FIG. 21 is a graph comparing the illustrative embodiment and the conventional configuration with respect to the variation of the flux density in the tangential direction in relation to FIG. 20.
Figure 22:
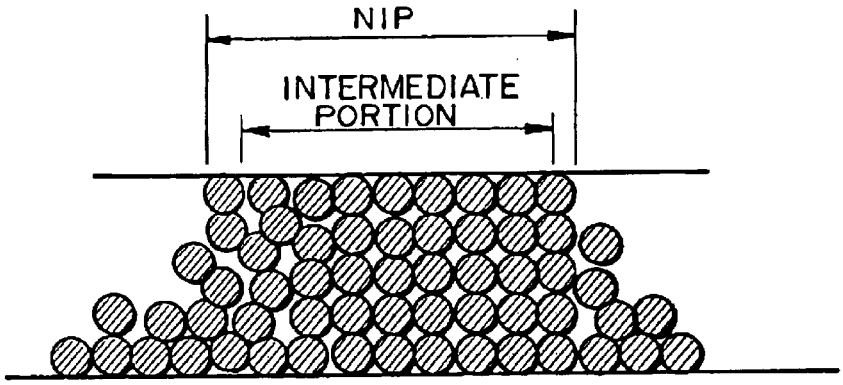
FIG. 22 is a sketch showing a magnetic brush formed at the nip in relation to FIG. 20.

As stated above, the variation of the flux density by 40 T/m successfully narrowed the inlet portion and outlet portion of the nip and thereby broadened the intermediate portion where the magnet brush fully contacted the drum. FIG. 20 shows a specific flux density distribution in the tangential direction achievable with the magnet roller of the illustrative embodiment. FIG. 21 compares the illustrative embodiment and the conventional configuration with respect to the variation of the flux density in the tangential direction. Further, FIG. 22 shows the condition of the magnet brush (carrier) at the nip.

Figure 23A:
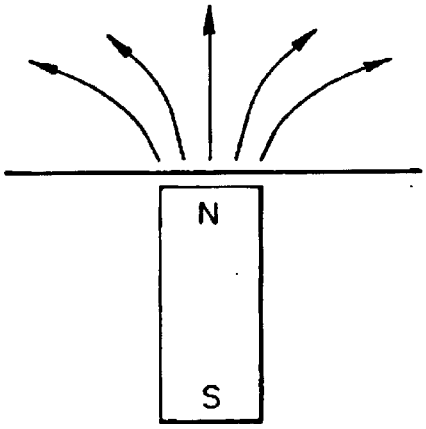
FIG. 23A PRIOR ART
FIG. 23A shows a conventional magnet brush to be formed when a developing sleeve has a large diameter.
Figure 23B:
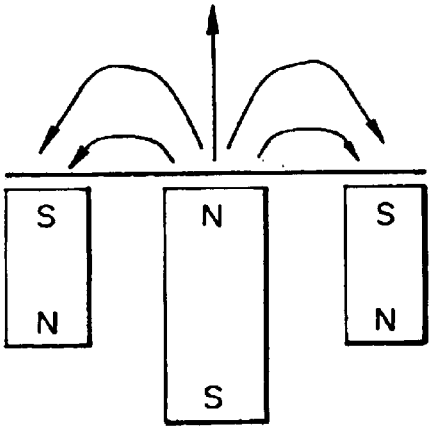
FIG. 23B shows a specific combination of a main magnetic pole and auxiliary magnetic poles.

The problem with the magnetic field configuration described above is that when the diameter of the sleeve is increased, the distance between nearby poles increases with the result that the vector of the flux density extends, as shown in FIG. 23A. This makes it difficult to increase the variation of the flux density in the tangential direction. In light of this, auxiliary poles are arranged at opposite sides of the main pole, as is the case with the magnet roller 286. As shown in FIG. 23B, the vector of the flux density issuing mainly from the center of the main pole concentrates on the auxiliary poles, increasing the variation of the flux density. In addition, the auxiliary poles allow the magnetic brush to rise in a body without fail and thereby obviate local omission.

Figure 24A:
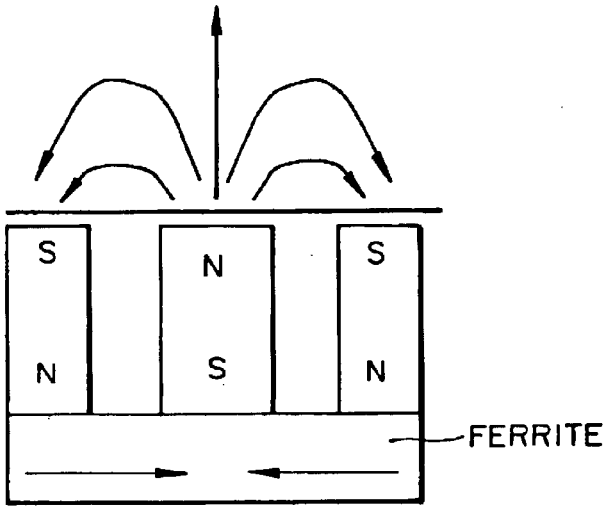
FIG. 24A shows a specific combination of a main magnetic pole, auxiliary magnetic poles and a jig that reduces a leakage magnetic field.

A leakage magnetic field is sometimes formed at each of the main magnet and magnets adjoining it, lowering the flux density on the sleeve surface to a noticeable degree. A leakage magnetic field may be coped with if the main magnet has a high energy product. FIG. 24A shows an alternative implementation practicable with a low-cost magnet having a low energy product. As shown, a jig for reducing a leakage magnetic field is arranged around the main pole and auxiliary poles adjoining it in order to guarantee the size of a magnetic field formed on the sleeve surface.

To obviate a leakage magnetic field, use may be made of ion or similar soft magnetic material having high permeability. A soft magnetic material is susceptible to a magnetic field around it, i.e., highly magnetized in a high magnetic field or not magnetized when the magnetic field disappears. A soft magnetic material has a weak coercive force and high permeability. Soft magnetic materials include pure iron, silicon-iron alloy and iron-nickel alloy as well as iron. A high flux density is available with a soft magnetic material and increases the flux density on the sleeve surface because of the mirror effect, so that a ferrite or similar low-cost magnet can be used. More specifically, when soft magnetic ferrite having high permeability is positioned between ferrite magnets, a magnetic field can be efficiently formed on the sleeve.

Figure 24B:
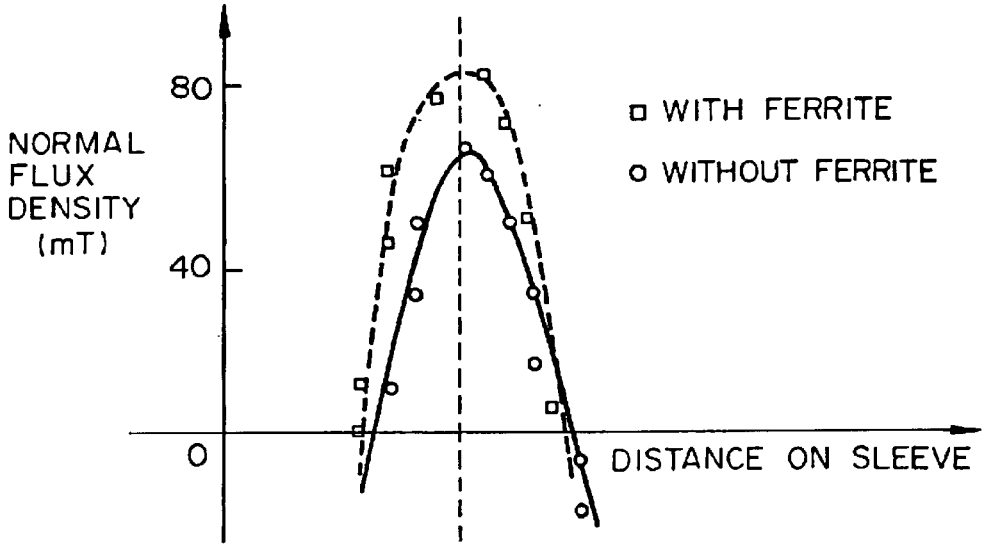
FIG. 24B is a graph showing how the flux density in the normal direction varies in the configuration of FIG. 24A.

Assume that the magnets P1*a*, P1*b* and P1*c* each are implemented by a 1.6 mm wide ferrite magnet and arranged as shown in FIG. 24A together with a 2 mm thick, iron (ferrite) jig. FIG. 24B shows how the flux density in the normal direction varies on the sleeve surface at the main pole P1*b*, as determined with the above specific arrangement. As shown, the iron (ferrite) jig successfully raises the flux density on the sleeve surface.

Figure 25A:
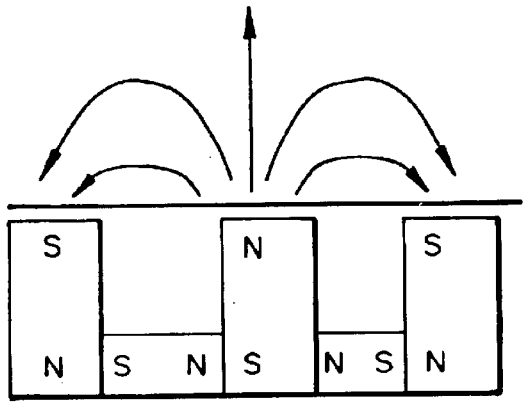
FIG. 25A shows another specific configuration in which the jig is implemented by magnets.
Figure 25B:
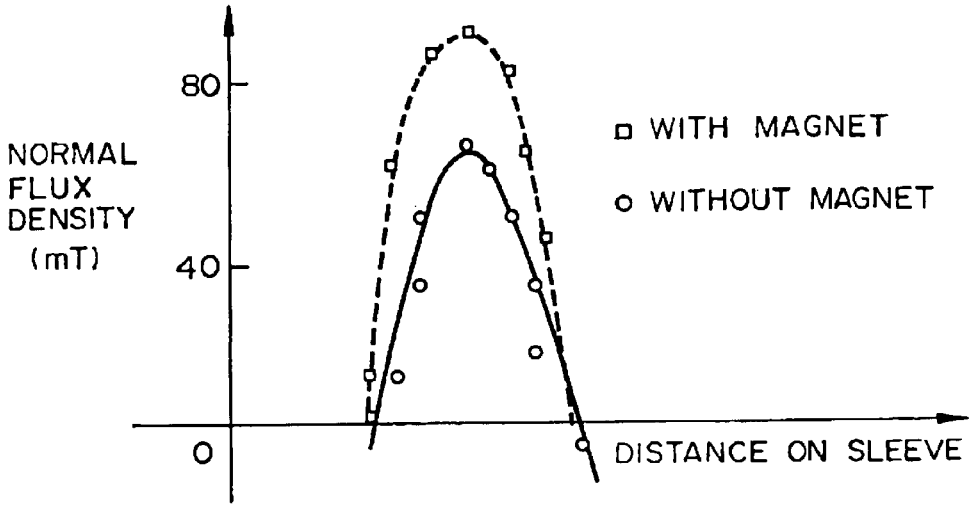
FIG. 25B is a graph showing how the flux density in the normal direction varies in the configuration of FIG. 25A.

FIG. 25A shows another specific arrangement of magnets. With this arrangement, too, it is possible to obviate a leakage magnetic field and increase the volume of the magnets and therefore the flux density on the sleeve surface. FIG. 25B shows the variation of the flux density on the sleeve surface, as measured at the position of the main pole.

The illustrative embodiment achieves various unprecedented advantages, as enumerated below.

(1) A flux density in the tangential direction available with a main pole varies relative to a distance on a sleeve surface with the maximum value of 40 T/m or above in absolute value, which is positioned upstream of substantially the center of a developing region. A magnet brush therefore sharply rises in a body in the inlet portion of the developing region and reduces the granularity of the resulting image.

(2) When the maximum value mentioned above is positioned downstream of substantially the center of the developing region and has an absolute value of 40 T/m or above, the magnet brush sharply falls down in a body in the outlet portion of the developing region. This minimizes the probability that the magnet brush sweeps off toner deposited on an image carrier and brings about local omission.

(3) When the maximum value of the variation of the flux density is positioned at substantially the center of the developing region and has an absolute value of 40 T/m or above, granularity and local omission can be reduced at the same time.

(4) Auxiliary poles helping the main pole form a magnetic force allow the flux density in the tangential direction to vary in a greater amount without regard to the sleeve diameter. A jig, which reduces the leakage magnetic field of the main pole, allows a magnetic field to be efficiently formed on the sleeve. It is therefore possible to use a low-cost magnet although an energy product available with such a magnet is small. An alternating electric field applied during development realizes high-definition images by further reducing granularity.

Various modifications will become possible for those skilled in the art after receiving the teachings of the present disclosure without departing from the scope thereof.

What is claimed is:

1. In a developing device comprising a plurality of developing sections each including a developer carrier that causes a developer deposited thereon to form a magnet brush and contact an image carrier, said developer carrier comprising: a rotatable nonmagnetic sleeve; and a stationary magnet roller accommodated in said sleeve and including a magnetic pole for scooping up the developer to said sleeve, a magnetic pole for conveying said developer deposited on said sleeve, and a main magnetic pole for causing said developer to rise on said sleeve in a form of the magnet brush; wherein said plurality of developing sections include at least one developing section in which a flux density of said main magnetic pole in a normal direction has an attenuation ratio of 40% or above and at least one developing section in which said flux density has an attenuation ratio of 30% or below.

2. The device as claimed in claim 1, wherein said developing section with the attenuation ratio of 40% or above stores black toner while said developing section with the attenuation ratio of 30% or below stores toner of another color.

3. The device as claimed in claim 2, wherein said developing section storing the black toner is implemented as a stand-alone developing unit while said developing section storing toner of another color is implemented as part of a revolver.

4. The device as claimed in claim 2, wherein said plurality of developing sections are constructed into a revolver.

5. The device as claimed in claim 4, wherein said plurality of developing sections are matched in weight to thereby balance rotation of said revolver.

6. The device as claimed in claim 5, wherein said developing section with the attenuation ratio of 40% or above further includes an auxiliary magnetic pole for helping the main magnetic pole form a magnetic force.

7. The device as claimed in claim 5, wherein any one of said plurality of developing sections whose main pole has a half width of 22. degrees or below further includes an auxiliary magnetic pole for helping the main magnetic pole form a magnetic force.

8. The device as claimed in claim 1, wherein said plurality of developing sections are constructed into a revolver.

9. The device as claimed in claim 8, wherein said plurality of developing sections are matched in weight to thereby balance rotation of said revolver.

10. The device as claimed in claim 9, wherein said developing section with the attenuation ratio of 40% or above further includes an auxiliary magnetic pole for helping the main magnetic pole form a magnetic force.

11. The device as claimed in claim 9, wherein any one of said plurality of developing sections whose main pole has a half width of 22. degrees or below further includes an auxiliary magnetic pole for helping the main magnetic pole form a magnetic force.

12. In a process cartridge comprising a developing device and an image carrier, said developing device comprising a plurality of developing sections each including a developer carrier that causes a developer deposited thereon to form a magnet brush and contact said image carrier; said developer carrier comprising: a rotatable nonmagnetic sleeve; and a stationary magnet roller accommodated in said sleeve and including a magnetic pole for scooping up the developer to said sleeve, a magnetic pole for conveying said developer deposited on said sleeve, and a main magnetic pole for causing said developer to rise on said sleeve in a form of the magnet brush; wherein said plurality of developing sections include at least one developing section in which a flux density of said main magnetic pole in a normal direction has an attenuation ratio of 40% or above and at least one developing section in which said flux density has an attenuation ratio of 30% or below.

13. The process cartridge as claimed in claim 12, wherein said developing section with the attenuation ratio of 40% or above stores black toner while said developing section with the attenuation ratio of 30% or below stores toner of another color.

14. The process cartridge as claimed in claim 13, wherein said developing section storing the black toner is implemented as a stand-alone developing unit while said developing section storing toner of another color is implemented as part of a revolver.

15. The process cartridge as claimed in claim 12, wherein a gap for development between said image carrier and said developer carrier is reduced only in one of said plurality of developing sections storing black toner.

16. The process cartridge as claimed in claim 15, wherein said developer carrier of the developing section storing the black toner has a greater diameter than developer carriers of the other developing sections storing toner of other colors.

17. In a color image forming apparatus comprising a developing device, said developing device comprising a plurality of developing sections each including a developer carrier that causes a developer deposited thereon to fonri a magnet brush and contact an image carrier, said developer carrier comprising: a rotatable nonmagnetic sleeve; and a stationary magnet roller accommodated in said sleeve and including a magnetic pole for scooping up the developer to said sleeve, a magnetic pole for conveying said developer deposited on said sleeve, and a main magnetic pole for causing said developer to rise on said sleeve in a form of the magnet brush; wherein said plurality of developing sections include at least one developing section in which a flux density of said main magnetic pole in a normal direction has an attenuation ratio of 40% or above and at least one developing section in which said flux density has an attenuation ratio of 30% or below.

18. The apparatus as claimed in claim 17, wherein said developing section with the attenuation ratio of 40% or above stores black toner while said developing section with the attenuation ratio of 30% or below stores toner of another color.

19. The apparatus as claimed in claim 18, wherein said developing section storing the black toner is implemented as a stand-alone developing unit while said developing section storing toner of another color is implemented as part of a revolver.

20. The apparatus as claimed in claim 17, wherein a gap for development between said image carrier and said developer carrier is reduced only in one of said plurality of developing sections storing black toner.

21. The apparatus as claimed in claim 17, wherein said developer carrier of the developing section storing the black toner has a greater diameter than developer carriers of the other developing sections storing toner of other colors.

22. In a color image forming apparatus comprising a process cartridge that comprises a developing device and an image carrier, said developing device comprising a plurality of developing sections each including a developer carrier that causes a developer deposited thereon to form a magnet brush and contact said image carrier, said developer carrier comprising: a rotatable nonmagnetic sleeve; and a stationary magnet roller accommodated in said sleeve and including a magnetic pole for scooping up the developer to said sleeve, a magnetic pole for conveying: said developer deposited on said sleeve, and a main magnetic pole for causing said developer to rise on said sleeve in a form of the magnet brush; wherein said plurality of developing sections include at least one developing section in which a flux density of said main magnetic pole in a normal direction has an attenuation ratio of 40% or above and at least one developing section in which said flux density has an attenuation ratio of 30% or below.

23. The apparatus as claimed in claim 22, wherein said developing section with the attenuation ratio of 40% or above stores black toner while said developing section with the attenuation ratio of 30% or below stores toner of another color.

24. The apparatus as claimed in claim 23, wherein said developing section storing the black toner is implemented as a stand-alone developing unit while said developing section storing toner of another color is implemented as part of a revolver.

25. The apparatus as claimed in claim 22, wherein a gap for development between said image carrier and said developer carrier is reduced only in one of said plurality of developing sections storing black toner.

26. The apparatus as claimed in claim 25, wherein said developer carrier of the developing section storing the black toner has a greater diameter than developer carriers of the other developing sections storing toner of other colors.

* * * * *